United States Patent [19]

Calise

[11] 4,181,090

[45] Jan. 1, 1980

[54] DIAL-A-METRIC

[76] Inventor: Carl M. Calise, 903 E. 19 St., Brooklyn, N.Y. 11230

[21] Appl. No.: 925,922

[22] Filed: Aug. 23, 1978

[51] Int. Cl.[2] ..... G06C 17/00

[52] U.S. Cl. ..... 116/309; 235/88 R

[58] Field of Search ..... 116/133, DIG. 47, 309, 116/232, 62.2; 40/495, 115; 35/74; 235/88

[56] References Cited

U.S. PATENT DOCUMENTS

| | | | |
|---|---|---|---|
| 331,264 | 3/1885 | Tucker | 235/88 |
| 784,660 | 3/1905 | Chritton | 235/88 |
| 1,441,914 | 1/1923 | Deisch | 235/88 |
| 1,849,379 | 3/1932 | Passek | 40/495 |
| 2,780,201 | 2/1957 | Dzaack | 116/133 |
| 2,912,776 | 11/1959 | Koerber | 116/133 |
| 3,716,015 | 2/1973 | Godfrey | 116/133 |

*Primary Examiner*—Gerald Goldberg
*Assistant Examiner*—Denis E. Corr

[57] ABSTRACT

"DIAL-A-METRIC" is a measuring device with top and bottom rotating dials and a stationary center dial inscribed with six calibrated scales on two sides. The top and bottom dials have three die cut hairline windows on each side. When the two dials are rotated, the six windows reveal twelve different calibrated scales that converts existing American weights and measures to the International metric system.

1 Claim, 4 Drawing Figures

DIAL-A-METRIC

BRIEF SUMMARY

This invention is drawn to a hand manipulated, system of units conversion device employing three relatively rotatable disks, two discs having windows viewing indicia on a third middle disc.

DRAWINGS

Figure 1:
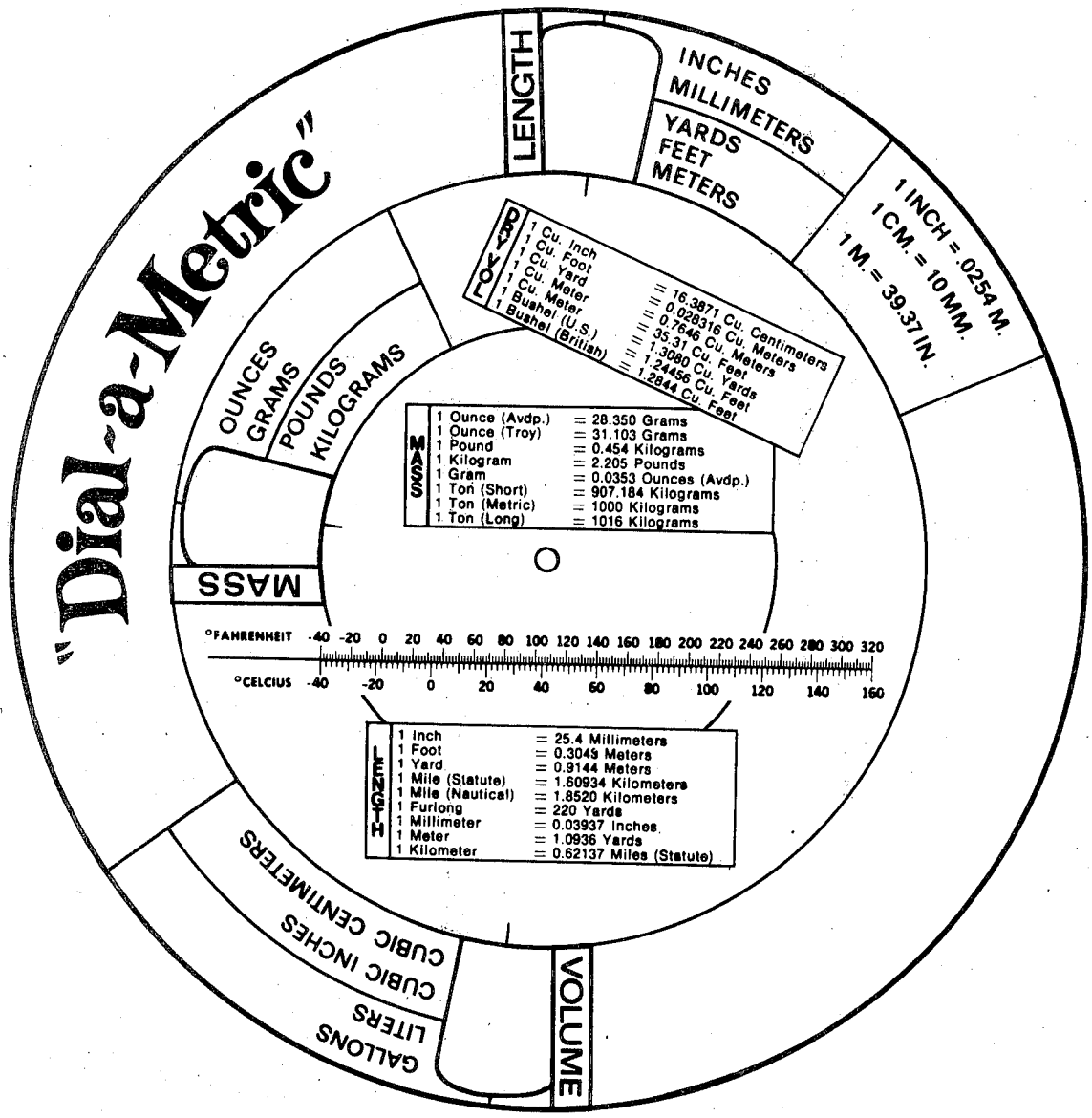
FIG. 1 is a view of the top rotating dial with three die cut hairline windows.

FIG. 1 "LENGTH" die cut window, vertical hairline converts inches to millimeters, yards, feet to meters. "VOLUME" die cut window, vertical hairline converts gallons to liters, cubic inches to cubic centimeters. "MASS" die cut window, vertical hairline converts ounces to grams, pounds to kilograms. FIG. 1 is mounted on top of FIG. 2.

Figure 2:
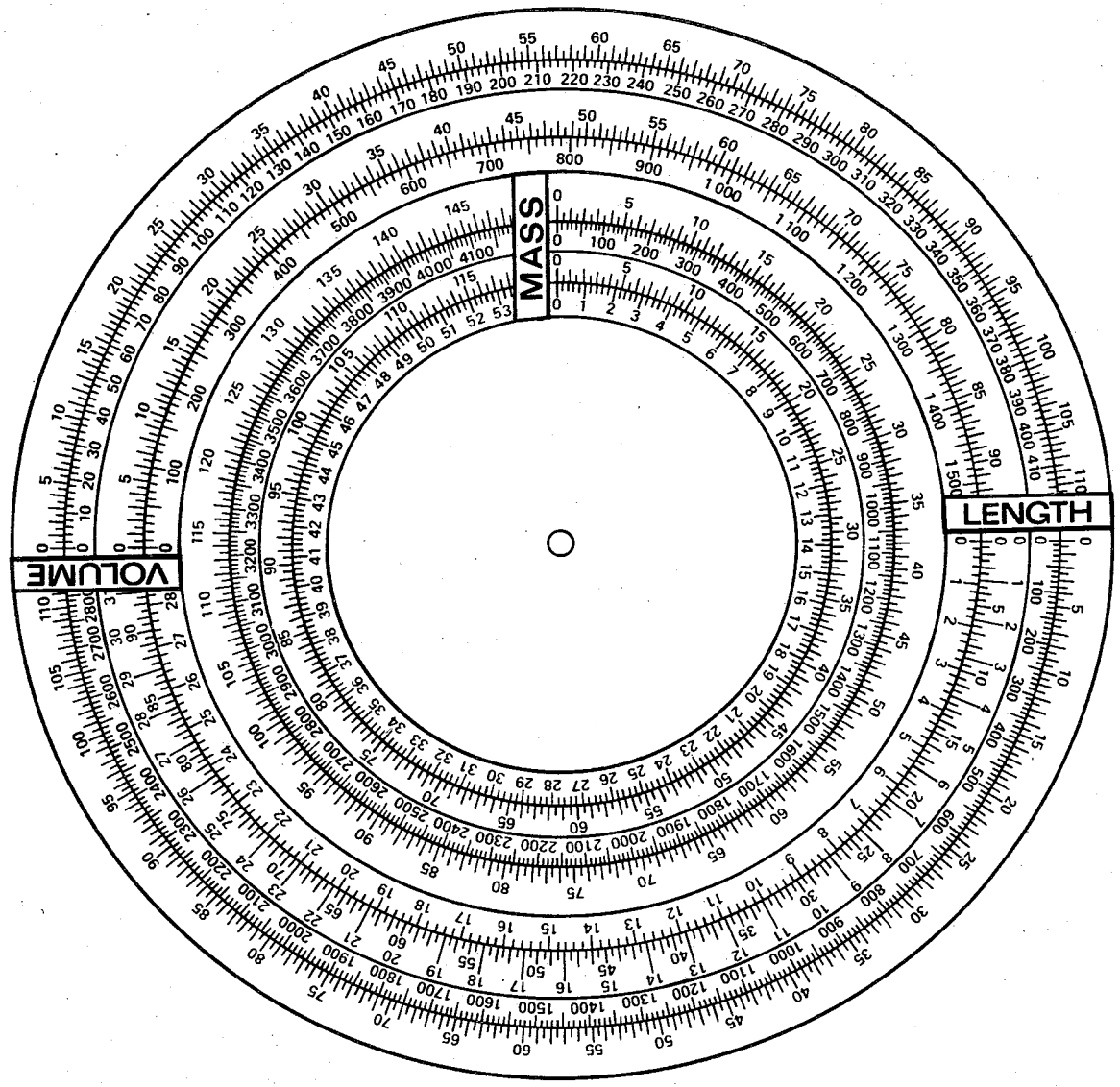
FIG. 2 is a view of the top center dial with six different calibrated scales.

FIG. 2 "LENGTH" scale converts inches to millimeters, yards, feet to meters. "VOLUME" scale converts gallons to liters, cubic inches to cubic centimeters. "MASS" scale converts ounces to grams, pounds to kilograms.

Figure 3:
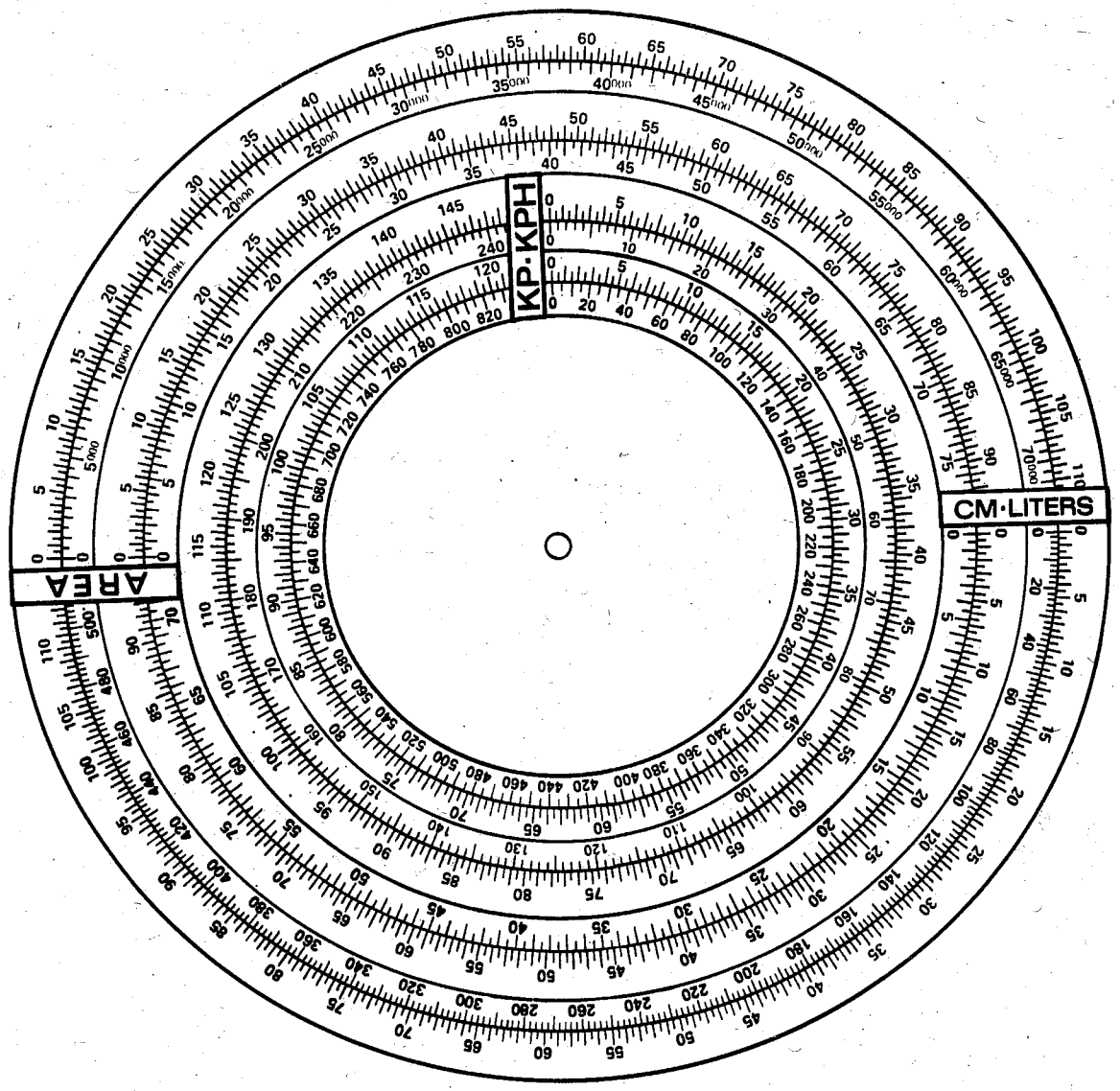
FIG. 3 is a view of the bottom center dial with six different calibrated scales.

FIG. 2 is mounted back to back with FIG. 3.

FIG. 3 "CM-LITERS" scale converts Imperial gallons to liters, cubic yards to cubic meters. "AREA" scale converts sq. inches to sq. millimeters, sq. yards to sq. meters. "KP-KPH" scale converts miles per hour to kilometers per hour, pounds per sq. inch to kilopascals. FIG. 3 is mounted under FIG. 4.

Figure 4:
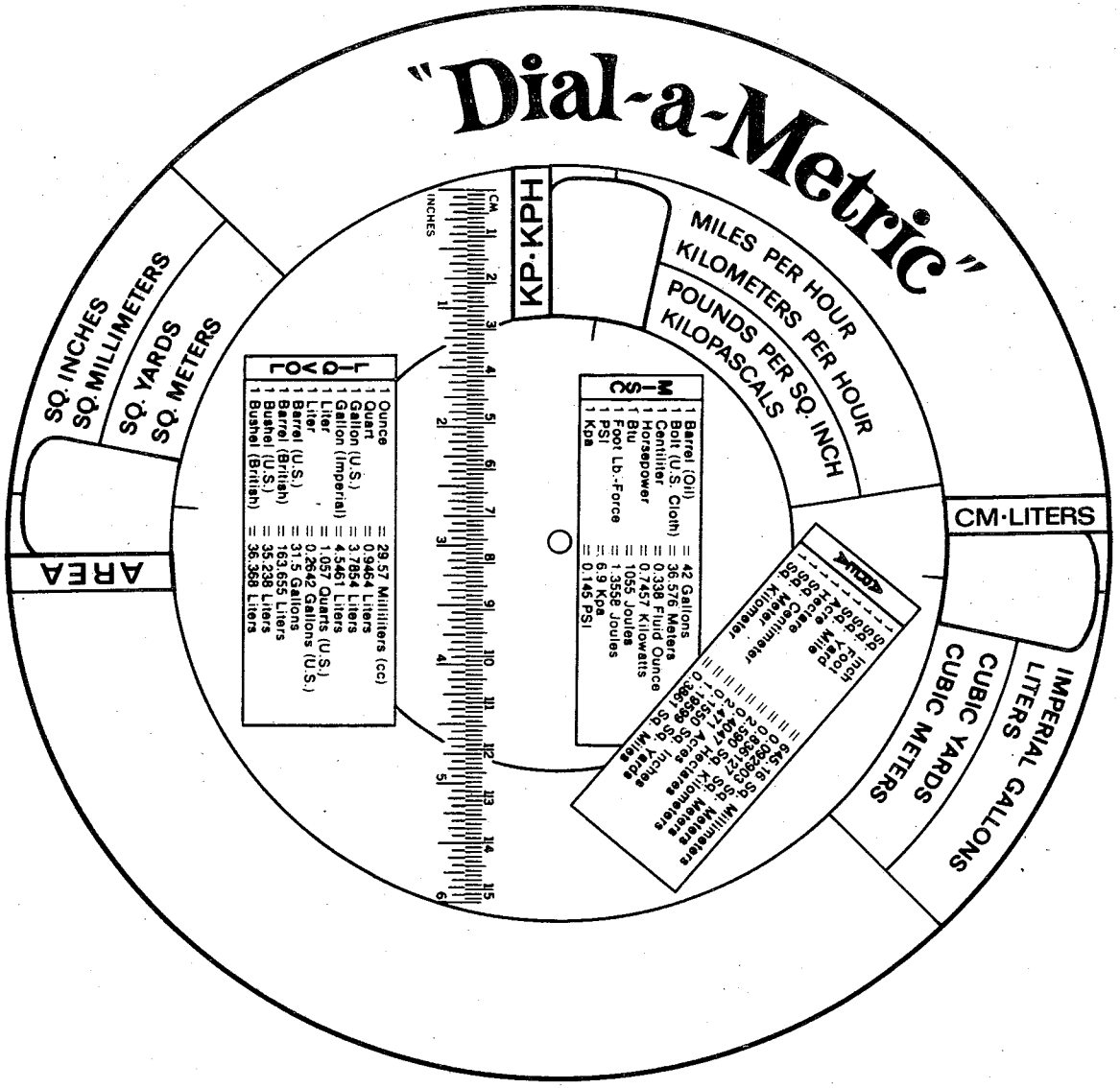
FIG. 4 is a view of the bottom rotating dial with three die cut hairline windows.

FIG. 4 "CM-LITERS" die cut window, vertical hairline converts Imperial gallons to liters, cubic yards to cubic meters. "AREA" die cut window, vertical hairline converts sq. inches to sq. millimeters, sq. yards to sq. meters. "KP-KPH" die cut window, vertical hairline converts miles per hour to kilometers per hour, pounds per sq. inch to kilopascals. FIGS. 1,2,3,4 are assembled together with a 3/16" grommet to allow FIG. 1 and FIG. 4 to rotate and observe the metric convertions, in the die cut windows.

I claim:

1. A system of units conversion device which includes:

three coaxial circular discs, two outside discs and an inside disc, mounted for relative rotation about their common axis;

the inside disc having sets of contiguous juxtapose circular scales arranged at least one radius with numerical indicia linearly related to their angular displacement about the common axis of said discs, such scales being on both faces of said inside disc and each set having a different identifying color background, each scale having the value of said numerical indicia also linearly related to a physical quantity, as described by a system of units;

the scales of each set being for the same physical quantity;

the outside discs each having a die cut window for each physcial quantity angularly separated about said common axis and at such radii to uncover at least one set of said scales per window and said windows having indicia with background color matching the corresponding said identifying color background of the sets of scales to clearly match said physical quantities of said windows to said scales, particularly where a plurality of windows have the same radius;

a hairline contiguous with each window;

wherein each set has at least one scale in one system of units and at least one other scale in another system of units whereby the conversion from said one system of units to the other system of units is facilitated.

* * * * *